US008905716B2

(12) United States Patent
Boyington

(10) Patent No.: US 8,905,716 B2
(45) Date of Patent: Dec. 9, 2014

(54) LADDER SEAL SYSTEM FOR GAS TURBINE ENGINES

(75) Inventor: Kimberly Pash Boyington, Haddam, CT (US)

(73) Assignee: United Technologies Corporation, Hartford, CT (US)

( * ) Notice: Subject to any disclaimer, the term of this patent is extended or adjusted under 35 U.S.C. 154(b) by 236 days.

(21) Appl. No.: 13/485,250

(22) Filed: May 31, 2012

(65) Prior Publication Data

US 2013/0323060 A1 Dec. 5, 2013

(51) Int. Cl.
*F01D 5/30* (2006.01)
*F01D 11/00* (2006.01)

(52) U.S. Cl.
USPC ..... 416/215; 416/218; 416/193 A

(58) Field of Classification Search
CPC . F05D 2240/90; F05D 2250/322; F01D 5/30; F01D 5/3038; F01D 11/005; F01D 11/006; F01D 11/008
USPC ..... 416/193 A, 195, 214 A, 215, 218, 219 R, 416/221, 222, 248
See application file for complete search history.

(56) References Cited

U.S. PATENT DOCUMENTS

| | | | | |
|---|---|---|---|---|
| 2,717,554 | A | 9/1955 | Stalker | |
| 2,948,505 | A | 8/1960 | Sonder | |
| 3,088,708 | A * | 5/1963 | Feinberg | 416/215 |
| 3,428,244 | A | 2/1969 | Palmer | |
| 3,709,631 | A | 1/1973 | Karstensen et al. | |
| 3,752,598 | A | 8/1973 | Bowers et al. | |
| 3,972,645 | A * | 8/1976 | Kasprow | 416/215 |
| 4,042,191 | A | 8/1977 | Johnson | |
| 4,183,720 | A | 1/1980 | Brantley | |
| 4,279,424 | A | 7/1981 | Zerlauth | |
| 4,311,432 | A | 1/1982 | Kildea | |
| 4,422,827 | A | 12/1983 | Buxe et al. | |
| 4,464,096 | A * | 8/1984 | Trousdell et al. | 416/215 |
| 4,505,642 | A | 3/1985 | Hill | |
| 4,626,002 | A | 12/1986 | Hagemeister et al. | |
| 4,643,638 | A | 2/1987 | Laurello | |
| 4,645,425 | A * | 2/1987 | Morrison, Jr. | 416/215 |
| 4,664,599 | A | 5/1987 | Robbins et al. | |
| 4,685,863 | A | 8/1987 | McLean | |
| 4,767,260 | A | 8/1988 | Clevenger et al. | |
| 4,875,830 | A * | 10/1989 | Trousdell et al. | 416/215 |

(Continued)

FOREIGN PATENT DOCUMENTS

| | | |
|---|---|---|
| EP | 0 305 223 A1 | 3/1989 |
| JP | 2003020995 A | 1/2003 |

OTHER PUBLICATIONS

International Search Report and Written Opinion, dated Nov. 13, 2013, for PCT Application No. PCT/US2013/043361, 9 pages.

*Primary Examiner* — Ned Landrum
*Assistant Examiner* — Joshua R Beebe
(74) *Attorney, Agent, or Firm* — Kinney & Lange, P.A.

(57) ABSTRACT

A sealing system for a gas turbine engine includes an arcuate first ladder seal segment having a central portion, an upstream flange adjoining the central portion, a downstream flange adjoining the central portion opposite the upstream flange, and a plurality of openings. The upstream flange is arranged at an angle $\theta_U$ greater than 0° and less than 90° relative to a given tangential plane, and the downstream flange is arranged at an angle $\theta_D$ greater than 0° and less than 90° relative to the given tangential plane.

19 Claims, 4 Drawing Sheets

(56) References Cited

U.S. PATENT DOCUMENTS

| | | | | |
|---|---|---|---|---|
| 5,820,338 | A | 10/1998 | Kasprow et al. | |
| 5,924,699 | A | 7/1999 | Airey et al. | |
| 6,254,344 | B1 | 7/2001 | Wright et al. | |
| 6,375,429 | B1 * | 4/2002 | Halila et al. | 416/193 A |
| 6,565,322 | B1 | 5/2003 | Lieser et al. | |
| 6,682,307 | B1 | 1/2004 | Tiemann | |
| 6,981,847 | B2 * | 1/2006 | Arinci et al. | 416/193 A |
| 7,334,331 | B2 * | 2/2008 | Bouchard et al. | 29/889.23 |
| 7,735,833 | B2 | 6/2010 | Braun et al. | |
| 8,011,892 | B2 | 9/2011 | Ramlogan et al. | |
| 8,025,296 | B2 | 9/2011 | Uehara et al. | |
| 8,043,050 | B2 | 10/2011 | Heinz-Schwarzmaier et al. | |
| 2004/0241001 | A1 * | 12/2004 | DiBella | 416/219 R |
| 2006/0222502 | A1 * | 10/2006 | Hansen et al. | 416/220 R |
| 2007/0014667 | A1 * | 1/2007 | Pickens et al. | 416/193 A |
| 2009/0208326 | A1 | 8/2009 | Durocher et al. | |
| 2010/0040479 | A1 | 2/2010 | Spangler et al. | |
| 2011/0268564 | A1 | 11/2011 | Martin et al. | |

* cited by examiner

LADDER SEAL SYSTEM FOR GAS TURBINE ENGINES

BACKGROUND

The present invention relates to seals and more particularly to seals for use with gas turbine engines.

Gas turbine engines include airfoils, such as blades and vanes, arranged in cascade configurations. These airfoils can be arranged in compressor or turbine sections of the engine. The airfoils can include a root (e.g., dovetail shaped root) that allows retention of the airfoil in a mounting structure, such as a rotor disk having one or more blade retention slots. For instance, a single circumferential rotor disk slot or a plurality of generally axial slots can be provided for airfoil retention. Many such airfoils include platforms that define a portion of an endwall or flowpath boundary adjacent to a working portion of the airfoil. In a cascade configuration, the platforms of adjacent airfoils adjoin one another at respective matefaces. However, gaps may remain between the matefaces of adjacent blades, and fluids can leak through those gaps. Fluid leakage can include the escape of fluid from a primary flowpath, leading to undesirable pressure loss. Ladder seals positioned between compressor rotor disks and blade platforms are known as a mechanism to provide mateface gap sealing. These ladder seals help reduce leakage of fluid between adjacent blade platforms, where gaps form. These seals are generally annular in configuration and resemble a "ladder" shape, with openings through which airfoil roots can pass.

It is desired to provide an improved ladder seal system.

SUMMARY

A sealing system for a gas turbine engine according to an aspect of the present invention includes an arcuate first ladder seal segment having a central portion, an upstream flange adjoining the central portion, a downstream flange adjoining the central portion opposite the upstream flange, and a plurality of openings. The upstream flange is arranged at an angle $\theta_U$ greater than 0° and less than 90° relative to a given tangential plane, and the downstream flange is arranged at an angle $\theta_D$ greater than 0° and less than 90° relative to the given tangential plane.

Figure 1:
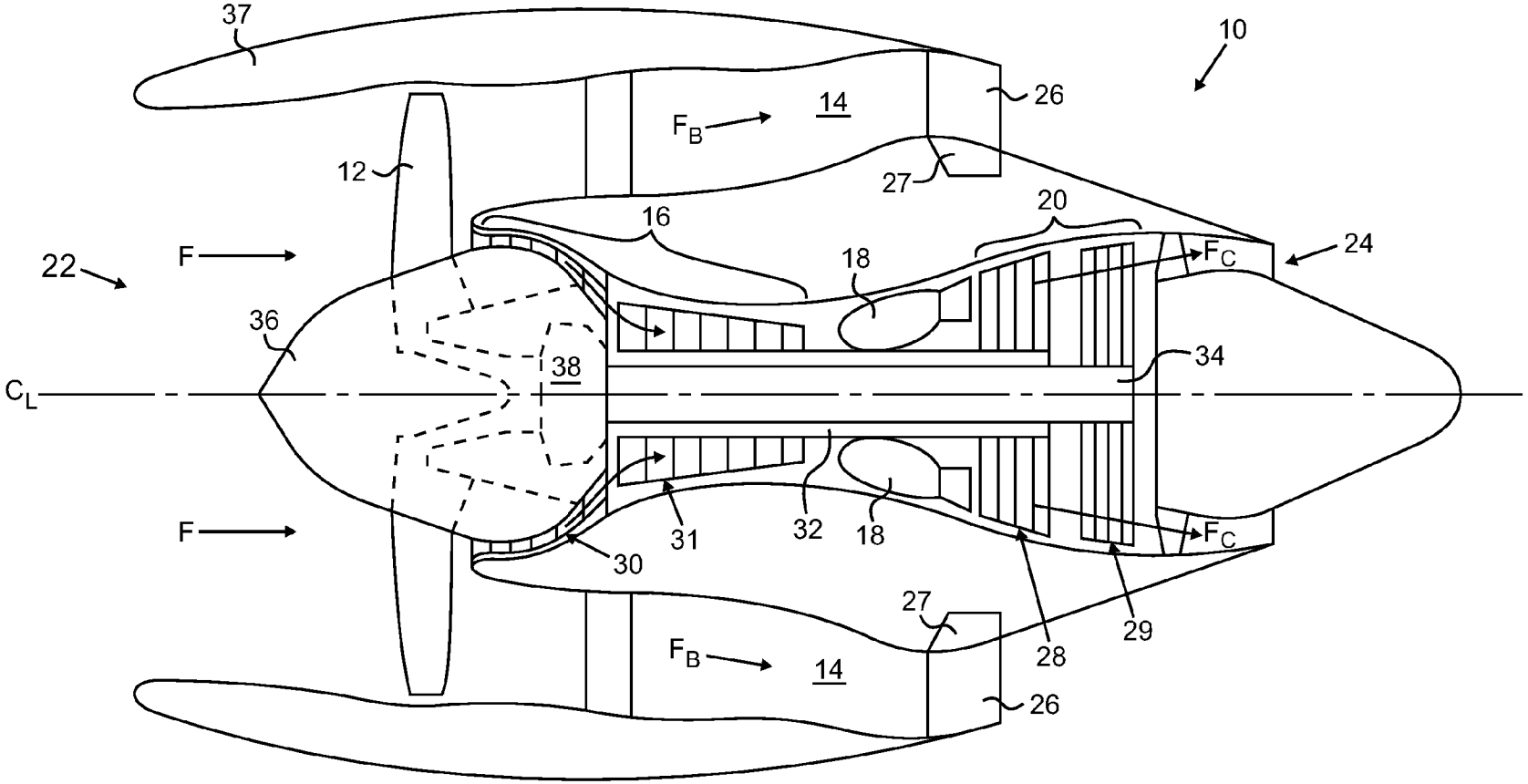
FIG. 1 is a schematic cross-sectional view of a gas turbine engine.

While the above-identified drawing figures set forth at least one embodiment of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings.

DETAILED DESCRIPTION

In general, the present invention provides a ladder seal system suitable for use with airfoils (e.g., blades or stators) in a gas turbine engine. For example, the ladder seal can be used for a high pressure compressor stage with a mounting disk (e.g., rotor disk) having a circumferential airfoil retaining groove, and can be positioned between the disk and the platforms of airfoils engaged with the disk. The ladder seal can include angled flanges along opposite upstream (that is, leading or forward) and downstream (that is, trailing or aft) edges. In general, the specific angles and widths of the ladder seal flanges can be configured to correspond to an underside surface of blade platforms that are positioned adjacent to the ladder seal. At the upstream edge the ladder seal can have a wider flange than the flange at the downstream edge, or vice-versa. The flanges can be angled greater than 0° and less than 90° (e.g., approx.) 15° with respect to a tangential plane or a plane at a central circumferential portion of the ladder seal. The ladder seal can be configured to flex to accommodate tolerance variations and variations in alignment between adjacent blade platforms. Openings are provided in the ladder seal to allow insertion of airfoil roots. Openings in the ladder seal can include at least one double or dumbbell-shaped opening to accommodate a blade lock used to secure the airfoils to the disk.

FIG. 1 is a schematic cross-sectional view of an embodiment of a gas turbine engine 10. The illustrated embodiment of the engine 10 shows a turbofan configuration, though persons of ordinary skill in the art will appreciate that other configurations are possible in further embodiments. The gas turbine engine 10 includes a fan section 12, a bypass duct 14, a turbine core that includes a compressor section 16, a combustor section 18 and a turbine section 20, which are arranged between an upstream inlet 22 and a downstream exhaust outlet 24. An airflow F can enter the engine 10 via inlet 22 and can be divided into a bypass flow $F_B$ and a core flow $F_C$. The bypass flow $F_B$ can pass through the bypass duct 14, generating thrust, and the core flow $F_C$ passes along a primary flowpath through the compressor section 16, the combustor section 18 and the turbine section 20.

A variable area nozzle 26 can be positioned in bypass duct 14 in order to regulate a bypass flow $F_B$ with respect to a core flow $F_C$, in response to adjustment by one or more actuators 27. Adjustment of the variable area nozzle 26 allows the turbofan 10 to control or limit a temperature of the core flow $F_C$, including during times of peak thrust demand.

The turbine section 20 can include a high-pressure turbine (HPT) section 28 and a low-pressure turbine (LPT) section 29. The compressor section 16 can include a low pressure compressor (LPC) or boost section 30 and a high pressure compressor (HPC) section 31. The compressor 16 and turbine 20 sections can each include a number of stages of airfoils, which can be arranged as alternating cascades of rotating blades and non-rotating vanes (or stators). The HPT section 28 is coupled to the HPC 31 via a HPT shaft 32, forming a high pressure spool. The LPT section 29 is coupled to the fan section 12 and the LPC 30 via a LPT shaft 34, forming the low pressure or fan spool. The LPT shaft 34 can be coaxially mounted within HPT shaft 32, about centerline axis $C_L$, such that the HPT and LPT spools can rotate independently (i.e., at different speeds).

The fan section 12 is typically mounted to a fan disk or other rotating member, which is driven by the LPT shaft 34. A spinner 36 can be included covering the fan disk to improve aerodynamic performance. As shown in FIG. 1, for example, the fan section 12 is forward-mounted in an engine cowling 37, upstream of the bypass duct 14. In alternative embodiments, the fan section 12 can be aft-mounted in a downstream location, with an alternative coupling configuration. Further, while FIG. 1 illustrates a particular two-spool high-bypass turbofan embodiment of turbine engine 10, this example is provided merely by way of example and not limitation. In other embodiments, the gas turbine engine 10 can be configured either as a low-bypass turbofan or a high-bypass turbofan, in a reverse-flow configuration, the number of spools can vary, etc.

In the particular embodiment of FIG. 1, the fan section 12 is coupled to the LPT shaft 34 via an optional planetary gear or other fan drive geared mechanism 38 (shown in dashed lines), which provides independent speed control. More specifically, the fan drive gear mechanism 38 allows the engine 10 to control the rotational speed of the fan section 12 independently of the high and low spool speeds (that is, independently of HPT shaft 32 and LPT shaft 34), increasing the operational control range for improved engine response and efficiency across an operational envelope.

In operation, compressor 16 compresses incoming air of the core flow $F_C$ for the combustor section 18, where at least a portion of that air is mixed with fuel and ignited to produce hot combustion gas. The combustion gas can exit the combustor section 18 and enter the HPT section 28, which drives the HPT shaft 32 and in turn drives the HPC 31. Partially expanded combustion gas transitions from the HPT section 28 to the LPT section 29, driving the fan section 12 and the LPC 30 via the LPT shaft 34 and, in some embodiments, the fan drive gear mechanism 38. Exhaust gas can exit the engine 10 via exhaust outlet 24.

Figure 2A:
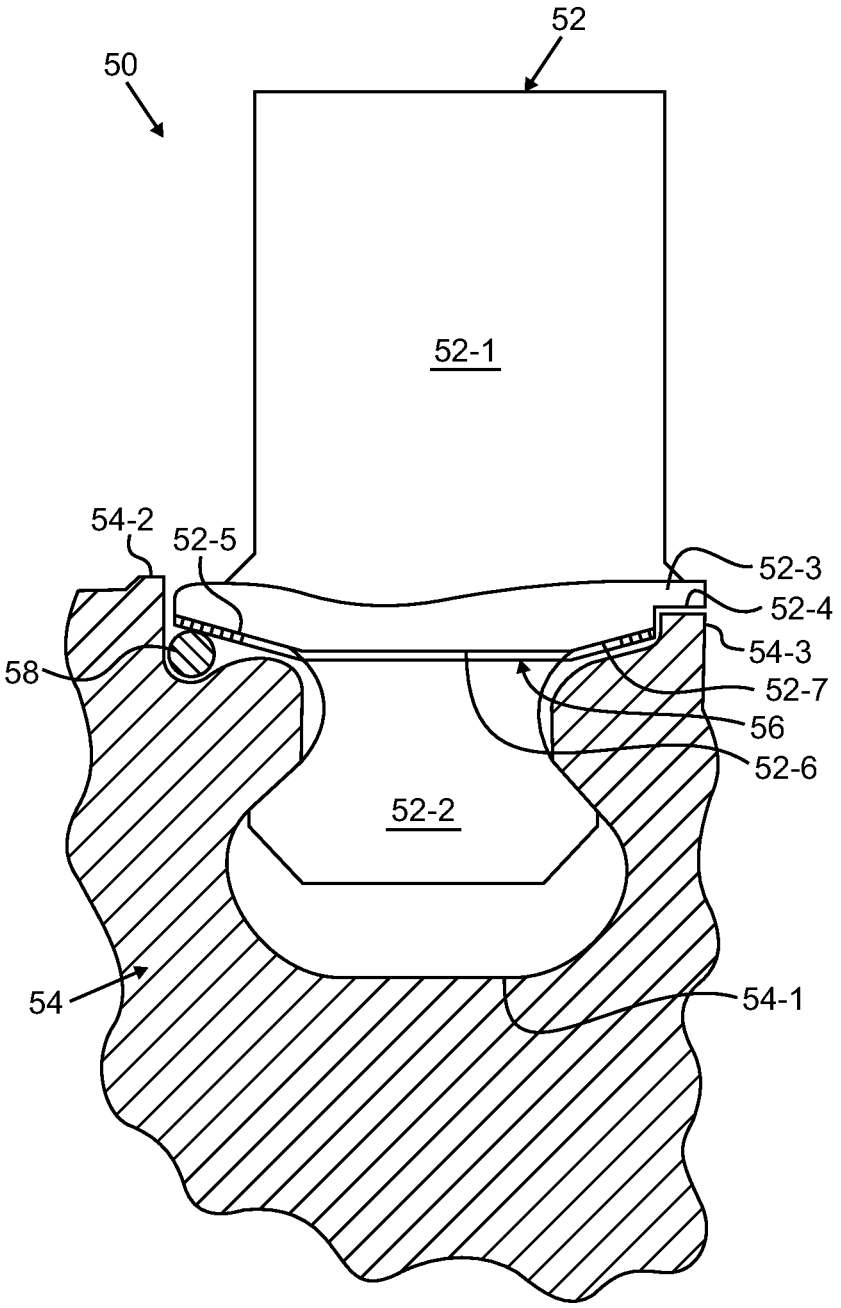
FIG. 2A is a cross-sectional view of a rotor disk assembly with a ladder seal system according to the present invention.
Figure 2B:
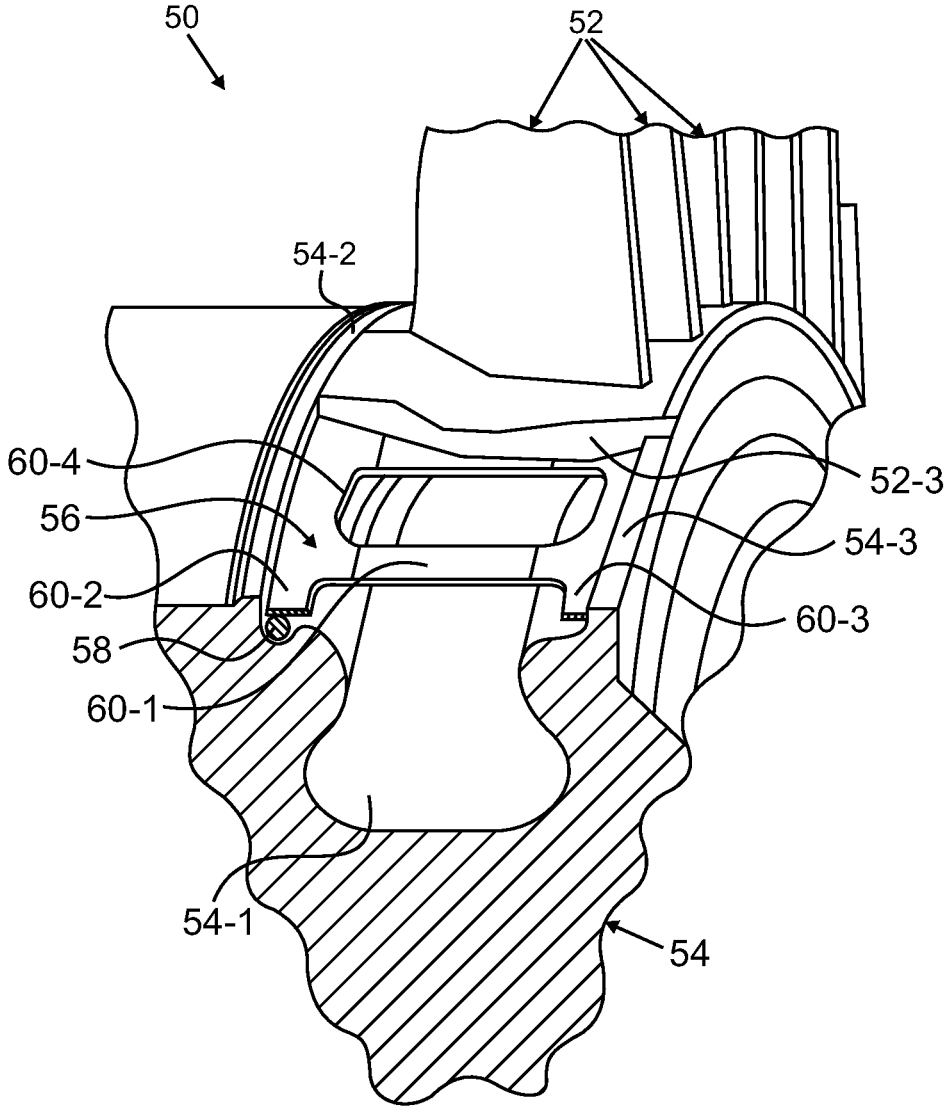
FIG. 2B is a cross-sectional perspective view of the rotor disk assembly with the ladder seal system.

FIGS. 2A and 2B are cross-sectional views of a rotor disk assembly 50 that includes airfoils 52 (e.g., rotor blades), a disk 54 (e.g., rotor disk), a ladder seal system 56, and an optional wire seal 58. The rotor disk assembly 50 can be a stage of the high pressure compressor 31, or can be in another section of the engine 10 in further embodiments. It should be noted that in FIG. 2B one airfoil 52 is omitted to better reveal otherwise hidden structures of the assembly 50.

As shown in the illustrated embodiment, each airfoil 52 can include a working portion 52-1, a root 52-2 and a platform 52-3 located between the working portion 52-1 and the root 52-2 (as used herein, the term "root" can also encompass what is sometimes separately referred to as a "shank"). The working portion 52-1 can be positioned to extend into a primary flowpath of the engine 10 to interact with a working fluid. The root 52-2 can have a dovetail shape or other desired shape to retain the airfoil 52 relative to the disk 54. The platform 52-3 can form a portion of a boundary of the primary flowpath. When positioned with other airfoils in a cascade, matefaces of adjacent platforms adjoin each other, with a small gap in between that runs in a generally upstream/downstream direction. Those of ordinary skill in the art will appreciate that airfoil platform matefaces can have a variety of configurations, from linear to non-linear, and can be arranged in an axial direction or at a non-parallel angle relative to the engine centerline $C_L$. The ladder seal system 56 can be utilized with nearly any type of mateface configuration.

At an underside (i.e., radially inner surface, as shown in the illustrated embodiment) of the platform 52-3, a notch 52-4, an upstream angled portion 52-5, a central portion 52-6, and a downstream angled portion 52-7 can be provided. The functions of these underside features of the platform features are explained further below.

The disk 54 includes at least one slot 54-1, which in the illustrated embodiment is a single circumferentially-extending slot at an outer rim of the disk 54. The slot 54-1 and the root 52-2 can have complementary shapes, allowing the slot 54-1 to radially retain the airfoil 52. A load feature (not shown) can be formed in the slot 54-1, or other suitable features provided, to facilitate insertion of the root 52-2 into the slot 54-1. Furthermore, a lock feature (not shown) can be provided in the slot 54-1 to allow engagement of an airfoil lock (not shown) to help secure a cascade of airfoils 52 in the slot 54-1.

The disk 54 can further include a ramped circumferential ridge 54-2 that extends radially outward from the outer rim on an upstream side of the slot 54-1 (i.e., on an upstream rail). The ridge 54-2 can protrude radially outward at least as far as a flowpath surface of the platform 52-3 of the airfoil 52, and be positioned upstream of a leading edge of the platform 52-3, in order to help reduce flow separation at or near the leading edge of the platform 52-3.

In addition, the disk 54 can further include a circumferentially-extending ridge 54-3 that extends radially outward from the outer rim on a downstream side of the slot 54-1 (i.e., on a downstream rail). The ridge 54-3 can be positioned generally upstream of a trailing edge of the platform 52-3 of the airfoil 52, that is, with a downstream edge of the ridge 54-3 located at or upstream of the trailing edge of the platform 52-3, such that the ridge 54-3 is positioned generally underneath the platform 54-3. The notch 52-4 can be formed in the platform 52-3 immediately upstream of the trailing edge and can have a shape that is complementary to a shape of the ridge 54-3 of the disk 54, with the ridge 54-3 extending into (i.e., radially overlapping with) the notch 52-4. A sealing effect is provided by the notch 52-4 and the ridge 54-3, which together alter the shape of a space between the platform 52-3 and the disk 54. In alternative embodiments, the notch 52-4 and the ridge 54-3 could instead be located at or near a leading edge of the platform 52-3 and an upstream rail of the disk 54, respectively.

The ladder seal system 56 includes one or more arcuate ladder seal segments that extend circumferentially and are located at least partially within the space between the platform 52-3 of the airfoil 52 and the disk 54. In one embodiment, two approximately 180° segments are provided, though in further embodiments only one segment or more than two segments can be utilized.

Figure 3:
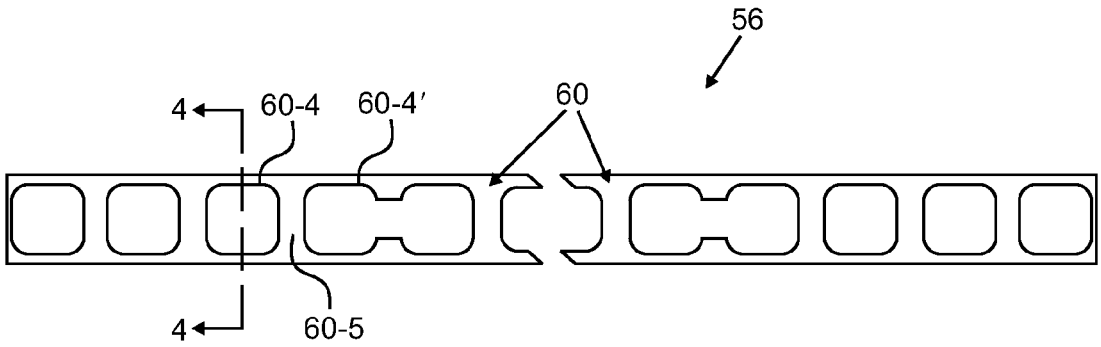
FIG. 3 is a top view of a ladder seal segment of the ladder seal system.
Figure 4:
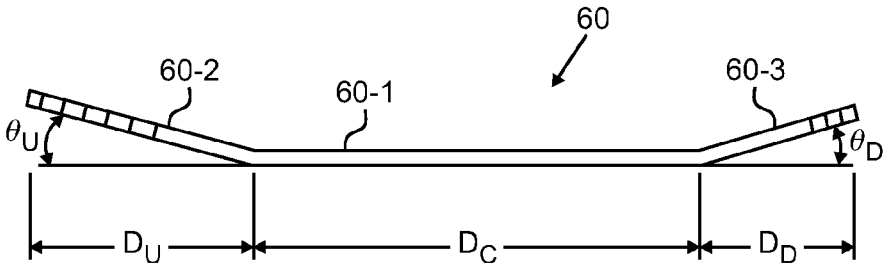
FIG. 4 is a cross-sectional view of the ladder seal segment, taken along line 4-4 of FIG. 3.

FIG. 3 is a top view of an embodiment of ladder seal segments 60 of the ladder seal system 56, and FIG. 4 is a cross-sectional view of one of the ladder seal segments 60, taken along line 4-4 of FIG. 3. The ladder seal segments 60 of the illustrated embodiment include a central portion 60-1, an upstream flange 60-2, a downstream flange 60-3, and a plurality of openings 60-4. The ladder seal segments 60 are asymmetric in the upstream/downstream or axial direction in the illustrated embodiment, though in alternative embodiments the segments 60 can be symmetric in the upstream/downstream or axial direction. The upstream flange 60-2 and the downstream flange 60-3 can be arranged to adjoin opposite sides of the central portion 60-1. In one embodiment, the ladder seal segments 60 can have a nominal thickness of approximately 0.254 mm (0.010 inch), or another thickness as desired.

The upstream flange 60-2 can be arranged at an angle $\theta_U$ greater than 0° and less than 90° relative to a given tangential plane 62 that is parallel to the centerline axis $C_L$. In one embodiment, the angle $\theta_U$ can be in the range of approximately 11.7° to 19.1°. In a further embodiment the angle $\theta_U$ can be approximately 15°. The upstream flange 60-2 can be configured to correspond to the upstream angled portion 52-5 of the platform 52-3, such that the upstream angled portion 52-5 is also arranged at the angle $\theta_U$. The downstream flange

60-3 can be arranged at an angle $\theta_D$ greater than 0° and less than 90° relative to the given tangential plane 62. In one embodiment, the angle $\theta_D$ can be in the range of approximately 11.3° to 18.5°. In a further embodiment the angle $\theta_D$ can be approximately 15°. The downstream flange 60-3 can be configured to correspond to the downstream angled portion 52-7 of the platform 52-3, such that the downstream angled portion 52-7 is also arranged at the angle $\theta_D$. The angles $\theta_U$ and $\theta_D$ can be selected such that the flanges 60-2 and 60-3 are angled radially outward, that is, toward the platforms 52-3 of the airfoils 52, when installed. The central portion 60-1 can have a substantially planar configuration and be arranged tangentially relative to the centerline axis $C_L$. In general, the shape of the segments 60 can correspond to a shape of the underside of the platform 52-3, with the upstream flange 60-2 corresponding to the upstream angled portion 52-5, the central portion 60-1 corresponding to the central portion 52-6, and the downstream portion 60-3 corresponding to the downstream angled portion 52-7. It should be noted that the particular angles and ranges of angles described above are provided merely by way of example and not limitation. Other angles and angle ranges are possible in further embodiments.

The upstream flange 60-2 can have a width $D_U$ in a direction parallel to the centerline axis $C_L$ (i.e., a projected width along the centerline axis $C_L$), the central portion 60-1 can have a width $D_C$ in the same direction (i.e., a projected width along the centerline axis $C_L$), and the downstream flange 60-3 can have a width $D_D$ in the same direction (i.e., a projected width along the centerline axis $C_L$). In some embodiments, the width $D_U$ can be different (e.g., greater than) the width $D_D$. For example, in one embodiment, the width $D_U$ can be in a range of approximately 0.312 to 0.389 cm (0.123 to 0.153 inches) and the width $D_D$ can be in a range of approximately 0.231 to 0.257 cm (0.091 to 0.101 inches). Dimensions of the seal segments 60 can be selected such that an upstream edge of each segment 60 terminates at or downstream of the leading edge of the platforms 52-3, and such that a trailing edge of each segment 60 terminates at or upstream of the notch 52-4. It should be noted that other dimensions are possible in further embodiments.

The openings 60-4 are provided to allow the roots 52-2 of the airfoils 52 to pass through the ladder seal segment 60. The number and size of the openings 60-4 can vary as desired for particular applications, and can vary as function of a size of the roots 52-2. The openings 60-4 are spaced apart such that body portions of the seal segments 60 generally form a "ladder" shape. The body portions of the segments 60 can rest against the underside surfaces of the platforms 52-3 of the airfoils 52, with portions 60-5 of the seal segments 60 in between adjacent openings 60-4 covering and sealing gaps between adjacent platform matefaces. In the illustrate embodiment, the openings 60-4 extend through the central portion 60-1 as well as portions of the upstream and downstream flanges 60-2 and 60-3. Circumferential ends of the segments 60 can terminate within the openings 60-4, to help avoid interruption of the portions 60-5 that provide sealing.

One or more dumbbell-shaped openings 60-4' can optionally be provided in the seal segments 60. The openings 60-4' can be formed in a shape resembling two adjacent openings 60-4 with a connection channel that forms a common opening space. The openings 60-4 can accommodate two roots 52-2 and a lock engaged with the slot 54-1 of the disk 54 that helps retain the airfoils 52.

The seal segments 60 can be made of a metallic material, and can be flexible to accommodate positional variations between platforms 52-3 of adjacent airfoils 52 that occur during operation or are the result of small manufacturing tolerance variations. Furthermore, the flanges 60-2 and 60-3 can flex relative to the central portion 60-1 of the seal segments 60 such that the seal segments can fit closely against the undersides of the platforms 52-3 to provide relatively good sealing.

If the optional wire seal 58 is provided, the wire seal 58 can abut an underside (i.e., radially inner surface) of the ladder seal segments 60.

Any relative terms or terms of degree used herein, such as "substantially", "essentially", "generally" and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, alignment or shape variations induced by thermal or rotational operational conditions, and the like.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims. For example, while described primarily with respect to an embodiment for a rotor assembly of a gas turbine engine compressor, the ladder sealing system of the present invention can also be utilized for stator assemblies and/or for turbine sections.

DISCUSSION OF POSSIBLE EMBODIMENTS

The following are non-exclusive descriptions of possible embodiments of the present invention.

A sealing system for a gas turbine engine can include an arcuate first ladder seal segment that includes a central portion; an upstream flange adjoining the central portion, wherein the upstream flange is arranged at an angle $\theta_U$ greater than 0° and less than 90° relative to a given tangential plane; and a downstream flange adjoining the central portion opposite the upstream flange, wherein the downstream flange is arranged at an angle $\theta_D$ greater than 0° and less than 90° relative to the given tangential plane; and a plurality of openings.

The system of the preceding paragraph can optionally include, additionally and/or alternatively, any one or more of the following features, configurations and/or additional components:

the upstream flange can have a width $D_U$ and the downstream flange has a width $D_D$, and wherein the width $D_U$ is not equal to the width $D_D$;

the upstream flange can have a width $D_U$ and the downstream flange has a width $D_D$, and wherein the width $D_U$ is greater than the width $D_D$;

the angle $\theta_U$ can be in the range of approximately 11.7° to 19.1°, and the angle $\theta_D$ can be in the range of approximately 11.3° to 18.5°;

the angle $\theta_U$ can be approximately 15°;

the angle $\theta_D$ can be approximately 15°;

an arcuate second ladder seal segment, wherein the first and second ladder seal segments are each approximately 180° segments;

an airfoil having a platform located adjacent to the ladder seal segment, the platform defining an upstream angled portion and a downstream angled portion, wherein the upstream angled portion is arranged at the angle $\theta_U$, and wherein the downstream angled portion is arranged at the angle $\theta_D$;

an airfoil having a platform located adjacent to the ladder seal segment, and a root; and a disk having an outer rim and a slot in which the root of the airfoil is retained, wherein the first ladder seal segment is positioned between the outer rim and the platform with the root extending through one of the plurality of openings;

the platform includes a notch and the disk includes a circumferential ridge at the outer rim, and wherein ridge extends radially into the notch;

the ladder seal is flexible;

the plurality of openings can each extend through at least portions of the central portion, the upstream flange, and the downstream flange; and/or the plurality of openings include a dumbbell or barbell-shaped opening.

A method for making a sealing arrangement for a gas turbine engine can include providing an annular seal segment; angling an upstream flange of the seal segment at an angle $\theta_U$ greater than 0° and less than 90° relative to a given tangential plane; angling a downstream flange of the seal segment at an angle $\theta_D$ greater than 0° and less than 90° relative to the given tangential plane; and forming an opening in the seal segment, wherein the opening extends through at least portions of both the upstream and downstream flanges.

The method of the preceding paragraph can optionally include, additionally and/or alternatively, any one or more of the following features and/or additional steps:

forming a notch in an airfoil platform, wherein the notch is located downstream of the seal segment; and positioning a circumferential ridge at least partially in the notch.

A sealing system for a gas turbine engine can include an airfoil having a platform and a root; a mounting disk having an outer rim and a slot in which the root of the airfoil is retained; and an arcuate first ladder seal segment positioned between the outer rim of the disk and the platform of the airfoil, the first ladder seal segment including a central portion; an upstream flange adjoining the central portion, wherein the upstream flange has a width $D_U$; a downstream flange adjoining the central portion opposite the upstream flange, wherein the downstream flange has a width $D_D$, and wherein the width $D_U$ is not equal to the width $D_D$; and a plurality of openings.

The system of the preceding paragraph can optionally include, additionally and/or alternatively, any one or more of the following features, configurations and/or additional components:

the upstream flange can be arranged at an angle $\theta_U$ greater than 0° and less than 90° relative to a given tangential plane, and the downstream flange can be arranged at an angle $O_D$ greater than 0° and less than 90° relative to the given tangential plane;

the angle $\theta_U$ can be in the range of approximately 11.7° to 19.1°, and the angle $\theta_D$ can be in the range of approximately 11.3° to 18.5°;

the plurality of openings each extend through at least portions of the central portion, the upstream flange, and the downstream flange; and/or the plurality of openings include a dumbbell or barbell-shaped opening.

The invention claimed is:

1. A sealing system for a gas turbine engine, the system comprising:

an arcuate first ladder seal segment that includes:

a central portion;

an upstream flange adjoining the central portion and defining an upstream edge of the segment that is angled radially outward relative to an arc radius of the arcuate first ladder segment, wherein in an uninstalled state the upstream flange is arranged at an angle $\theta_u$ greater than 0° and less than 90° relative to a given tangential plane; and a downstream flange adjoining the central portion opposite the upstream flange and defining a downstream edge of the segment that is angled radially outward relative to the arc radius of the arcuate first ladder segment, wherein in the uninstalled state the downstream flange is arranged at an angle $\theta_D$ greater than 0° and less than 90° relative to the given tangential plane; and a plurality of openings.

2. The system of claim 1, wherein the upstream flange has a width $D_U$ and the downstream flange has a width $D_D$, and wherein the width $D_U$ is not equal to the width $D_D$.

3. The system of claim 1, wherein the upstream flange has a width $D_U$ and the downstream flange has a width $D_D$, and wherein the width $D_U$ is greater than the width $D_D$.

4. The system of claim 1, wherein the angle $\theta_U$ is in the range of approximately 11.7° to 19.1°, and wherein the angle $\theta_D$ is in the range of approximately 11.3° to 18.5°.

5. The system of claim 1, wherein the angle $\theta_U$ is approximately 15°.

6. The system of claim 1, wherein the angle $\theta_D$ is approximately 15°.

7. The system of claim 1 and further comprising:

an arcuate second ladder seal segment, wherein the first and second ladder seal segments are each approximately 180° segments.

8. The system of claim 1 and further comprising:

an airfoil having a platform located adjacent to the ladder seal segment, the platform defining an upstream angled portion and a downstream angled portion, wherein the upstream angled portion is arranged at the angle $\theta_U$, and wherein the downstream angled portion is arranged at the angle $\theta_D$.

9. The system of claim 1 and further comprising:

an airfoil having a platform located adjacent to the ladder seal segment, and a root; and a disk having an outer rim and a slot in which the root of the airfoil is retained, wherein the first ladder seal segment is positioned between the outer rim and the platform with the root extending through one of the plurality of openings.

10. The system of claim 9, wherein the platform includes a notch and the disk includes a circumferential ridge at the outer rim, and wherein ridge extends radially into the notch.

11. The system of claim 1, wherein the ladder seal is flexible.

12. The system of claim 1, wherein the plurality of openings each extend through at least portions of the central portion, the upstream flange, and the downstream flange.

13. The system of claim 1, wherein the central portion has a flat configuration in cross-sectional profile, and wherein the upstream and downstream flanges each have a generally frusto-conical shape.

14. A sealing system for a gas turbine engine, the system comprising:

an arcuate first ladder seal segment that includes:

a central portion;

an upstream flange adjoining the central portion, wherein the upstream flange is arranged at an angle $\theta_U$ greater than 0° and less than 90° relative to a given tangential plane; and a downstream flange adjoining the central portion opposite the upstream flange, wherein the downstream flange is arranged at an angle $\theta_D$ greater than 0° and less than 90° relative to the given tangential plane; and a plurality of openings, wherein the plurality of openings include a dumbbell-shaped opening.

15. A sealing system for a gas turbine engine, the system comprising:

an airfoil having a platform and a root;

a mounting disk having an outer rim and a slot in which the root of the airfoil is retained; and an arcuate first ladder seal segment positioned between the outer rim of the disk and the platform of the airfoil, the first ladder seal segment including:

a central portion;

wherein a positive angle value for an angle $\theta_U$ or $\theta_D$ is relative to an arc radius of the arcuate first ladder segment; and an upstream flange adjoining the central portion, wherein the upstream flange has a width $D_U$, wherein the upstream flange is arranged at an angle $\theta_U$ greater than 0° and less than 90° relative to a given tangential plane in an uninstalled state; and a downstream flange adjoining the central portion opposite the upstream flange, wherein the downstream flange has a width $D_D$, and wherein the width $D_U$ is not equal to the width $D_D$, wherein the downstream flange is arranged at an angle $\theta_D$ greater than 0° and less than 90° relative to the given tangential plane in the uninstalled state; and a plurality of openings.

16. The system of claim 15, wherein the angle $\theta_U$ is in the range of approximately 11.7° to 19.1°, and wherein the angle $\theta_D$ is in the range of approximately 11.3° to 18.5°.

17. The system of claim 15, wherein the plurality of openings each extend through at least portions of the central portion, the upstream flange, and the downstream flange.

18. The system of claim 15, wherein the plurality of openings include a dumbbell-shaped opening.

19. The system of claim 15 and further comprising:

a wire seal positioned along a radially inner surface of at least one of the upstream and downstream flanges.

* * * * *